US005244541A

United States Patent [19]

Minton

[11] Patent Number: 5,244,541

[45] Date of Patent: * Sep. 14, 1993

[54] PULP TREATMENT METHODS

[75] Inventor: Mary L. Minton, Cloquet, Minn.

[73] Assignee: Potlatch Corporation, Cloquet, Minn.

[ * ] Notice: The portion of the term of this patent subsequent to Dec. 11, 2007 has been disclaimed.

[21] Appl. No.: 619,200

[22] Filed: Nov. 28, 1990

Related U.S. Application Data

[63] Continuation-in-part of Ser. No. 187,660, Apr. 4, 1988, Pat. No. 4,976,819.

[51] Int. Cl.[5] ..... D21C 9/00

[52] U.S. Cl. ..... 162/28; 162/56; 162/125; 162/129; 162/132

[58] Field of Search ..... 162/28, 56, 125, 123, 162/129, 130, 131, 132

[56] References Cited

U.S. PATENT DOCUMENTS

| | | | |
|---|---|---|---|
| 2,516,384 | 6/1950 | Hill et al. | 92/20 |
| 3,382,140 | 9/1968 | Henderson et al. | 162/28 |
| 4,036,679 | 7/1977 | Back et al. | 162/9 |
| 4,773,965 | 7/1988 | Glinski et al. | 162/9 |
| 4,976,819 | 12/1990 | Minton | 162/56 |

*Primary Examiner*—Thi Dang

*Attorney, Agent, or Firm*—Wells, St. John, Roberts, Gregory & Matkin

[57] ABSTRACT

A method of processing pulp comprises the following steps of a) mechanically refining pulp of up to 50% O.D. consistency; and b) mechanically treating the mechanically refined pulp by wringing, dewatering and compacting the mechanically refined pulp to permanently twist and kink individual fibers to a degree that is substantially irreversible when they are subsequently subjected to papermaking process steps, the refined and treated pulp having increased bulk and no reduction in Z-directional tensile over the same pulp that has not been mechanically refined and thereafter wrung, dewatered and compacted to twist and kink individual fibers. Alternately, the order of mechanically refining and mechanically treating can be reversed. The invention may have specific application to enhancing multi-layer paper products where pulp treated in accordance with the invention is utilized as core ply pulp in a multi-layer paper product. Treated pulp when made into a sheet also exhibits reduced wicking which may provide specific applicability in paperboard products which are used for containment of liquids.

80 Claims, 4 Drawing Sheets

+ = PILOT PLANT 1

× = LAB REFINER o = LAB REFINER

□ = PILOT PLANT 1

+ = PILOT PLANT 1

△ = PILOT PLANT 2

× = LAB REFINER

○ = LAB REFINER

HCR = HIGH CONSISTENCY REFINING

P = PLUG SCREW FEEDER

PULP TREATMENT METHODS

RELATED APPLICATION DATA

This patent resulted from a continuation-in-part application of U.S. patent application Ser. No. 07/187,660, filed Apr. 4, 1988 now U.S. Pat. No. 4,976,819.

TECHNICAL FIELD

This invention relates primarily to methods for manipulating or treating pulp to enhance particular properties in finished paper products produced from such pulp.

BACKGROUND OF THE INVENTION

There are many paper containing products that can benefit from increased bulk, if other properties can be maintained at acceptable levels. One such property is a required minimum amount of Z-directional bonding (measured as ZDT, Scott Bond or others). Z-directional bonding, as well as other bonding in certain paper products such as tissue, is frequently in conflict with other desired properties, such as softness. However, other products, such as multi-layer paperboard, require minimum acceptable amounts of Z-directional bonding in the finished product to provide adequate strength.

Some paper products that used to be made as single-ply are now being made with improved characteristics, or more economically, with multiple layers. Multi-layer paper products are comprised of a high bulk central core having from one to five layers, or plies, sandwiched between two or more high modulus external plies. This structure creates a very stiff sheet through the "I-beam" principle and produces a product with improved stiffness, smoothness, strength, rigidity and coating characteristics. Maximizing the bulk of the middle layer(s) then gives the stiffest over all product. Z-directional bonding is necessary in finished multi-layer paper products to prevent inter and intra layer delamination.

Normally in order to gain adequate bonding, the product is treated such as by paper pressing, pulp refining, pulp starch addition etc., and one accepts the usually lower bulk which is obtained. Generally, as one of bulk or Z-directional bonding goes up, the other goes down. This is illustrated by FIG. 1 which shows Scott Bond versus bulk for different degrees of mechanical refining. The data points within the circle in the lower center of the FIG. 1 were the indicated pulps that were not subjected to any refiner treatment. Conventional wisdom teaches that as one mechanically works pulp, bulk goes down and Scott Bond goes up, as indicated by the arrow pointing in an ascending direction along the curve of FIG. 1.

The usual approach to solving this problem with respect to manufacture of core ply pulp would be to take the best available pulp, and conventionally refine it to achieve adequate Z-directional bonding. Another or additional approach involves the addition of expensive additives to attain adequate Z-directional bonding. Using such an approach, one would then merely accept the bulk which was obtained in arriving at some minimum acceptable Z-directional bonding.

Another approach is to specially select pulp from tree species that are inherently high in bulk. If the availability of a desired species is adequate, and segregation of the species is feasible, this is one approach-although an expensive one. It requires log and chip separation, chip pile segregation, and either swinging the cooking and bleaching operation with large intermediate and final pulp storage, or construction of separate pulping and bleaching mills.

Certain paperboard products are used for the containment of liquids. Such products are typically coated with a barrier film usually consisting of high molecular weight hydrocarbons or thermoplastics. The finished board is then imprinted, cut, and folded into a particular container shape, such as a milk carton. However the inner fold edge that is cut will not be coated with a barrier film, therefore directly exposing unprotected paperboard to wicking of liquid within the finished, filled container.

It would be desirable to find or develop improved methods for treating pulp which maximize bulk, enabling low bulk species to be used in a desired application, yet at the same time maintain appropriate Z-directional bonding. It would also be desirable to find or develop improved methods which minimize the wicking action of the exposed inner edge in multi-layer paperboard products which are used for the containment of liquid.

BRIEF DESCRIPTION OF THE DRAWINGS

Preferred embodiments of the invention are described with reference to the accompanying drawings, which are described below.

DETAILED DESCRIPTION OF THE PREFERRED EMBODIMENTS

Figure 1:
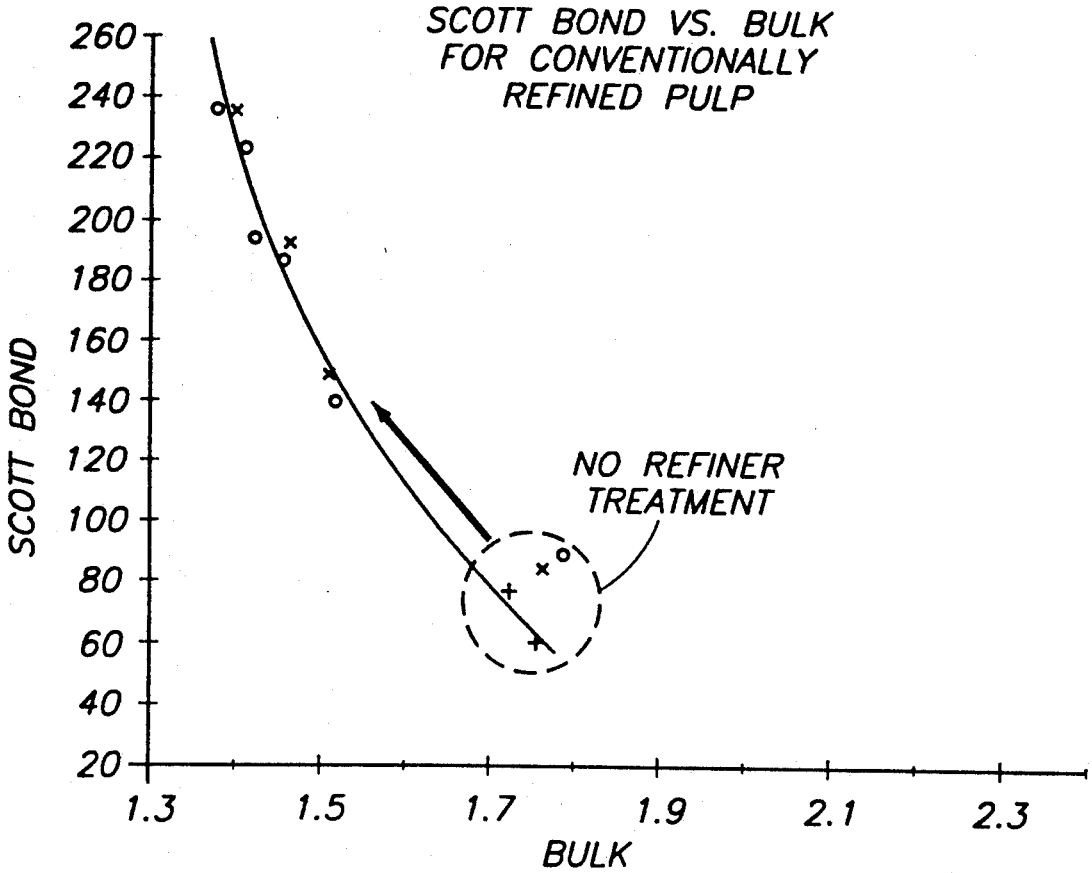
FIG 1 PRIOR ART
FIG. 1 is a graph of Scott Bond versus Bulk for conventional mechanically refined pulp, and is discussed in the Background Section above.

The following disclosure of the invention is submitted in furtherance with the constitutional purpose of the Patent Laws "to promote the progress of science and useful arts" (Article 1, Section 8).

One method of processing pulp in accordance with the invention comprises the following steps:

mechanically refining pulp of up to 50% O.D. consistency; and mechanically treating the mechanically refined pulp by wringing, dewatering and compacting the mechanically refined pulp to permanently twist and kink individual fibers to a degree that is substantially irreversible when they are subsequently subjected to papermaking process steps, the refined and treated pulp having increased bulk and no reduction in Z-directional tensile over the same pulp that has not been mechanically refined and thereafter wrung, dewatered and compacted to twist and kink individual fibers. Preferably, the wringing, dewatering and compacting occur simultaneously.

Alternately, but believed to be less preferred, the above order of treatment could be reversed, whereby the mechanical treating step is conducted first, followed thereafter by mechanically refining of the mechanically treated pulp. The mechanically treating preferably increases both bulk and Z-directional tensile over the same pulp that has not been mechanically refined and mechanically treated, regardless of the order of treatment. Further, the mechanical refining is preferably conducted at a high consistency of at least 20% pulp.

In the context of this document, the term "refining" means principally a mechanical treatment performed on pulp fibers by actions such as beating, bruising, cutting, and fibrillating fibers to generally increase the strength of the resulting fiber network and generally decrease the drainage characteristics of the pulp. Many different categories of equipment provide a refining action to pulp.

The preferred mechanical device for wringing, dewatering and compacting pulp is a plug screw feeder which moves the pulp along an annular path of decreasing volume. The plug screw feeder preferably would have a nominal compression ratio from 2.0:1 to 8.0:1, and will typically discharge pulp at about 50 to 60% O.D. Devices other than plug screw feeders are also anticipated to be useful for wringing, dewatering and compacting pulp without departing from the principles and scope of the invention. Where a plug screw feeder or similar device is used, the flow of pulp exiting therefrom is preferably restricted somewhat. One example of a restricting device is a blow-back damper, which is conventionally used to regulate pulp feed to a digester. Another example of a flow restriction device is an extended discharge tube, with or without an additional mechanical flow restricter. The mechanically treated and mechanically refined pulp is then processed into a finished paper product using conventional paper machines and paper making techniques.

Methods in accordance with the invention may have specific application to enhancing multi-layer paper products where pulp treated in accordance with the invention is utilized as core ply pulp in a multi-layer paper product. Upon treatment, the treated core ply pulp would be formed into a sheet in a wet end of a paper machine either together or in a separate step with formation of the outer sheet layers. The collective outer and core sheets would thereafter be pressed and dried to produce a multi-layer paper product having increased bulk without reduction in Z-directional tensile in the core ply over a multi-layer paper product produced with the same pulps having a core ply pulp that has not been mechanically refined and mechanically treated, regardless of the refining and treatment order.

It has also been discovered that treatment methods in accordance with the invention result in a paper product which exhibits reduced wicking. Accordingly, pulp treated in accordance with the invention may have specific applicability in paperboard products which are used for containment of liquids.

Figure 2:
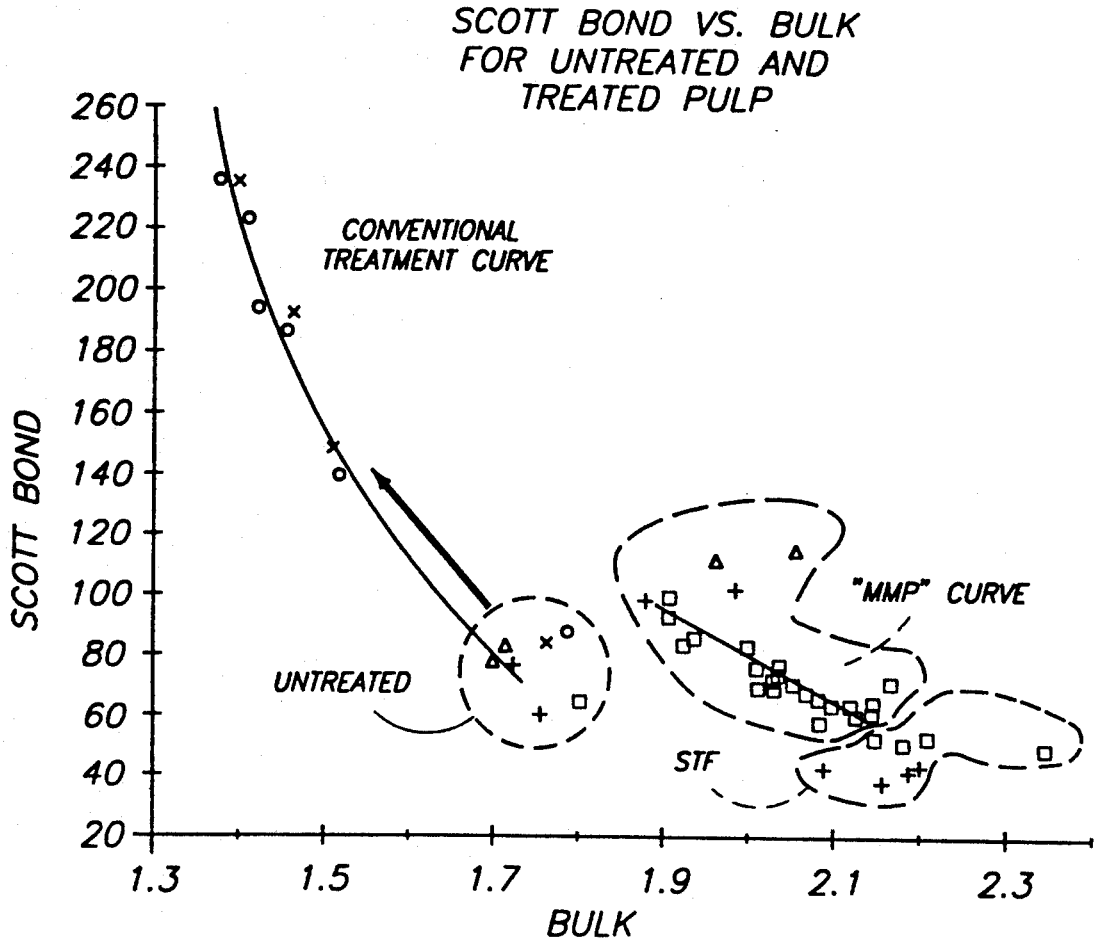
FIG. 2 is a graph of Scott Bond versus Bulk, illustrating properties of pulp treated in accordance with the invention as compared to conventional mechanically refined pulp that has not been treated in accordance with the invention.

Specific applicability of the invention for the core ply in paperboard products is evident from FIG. 2. There plotted is bulk versus Z bonding (reported as Scott Bond) for several pulps, and compares such with respect to pulp that has not been treated in accordance with the invention. The "MMP Curve" circle represents samples treated in accordance with the invention, with "MMP" being a shorthand for "mechanically modified pulp". Throughout this document, "MMP" refers to pulps that were treated in accordance with the invention of this disclosure. The samples designated "STF" (soft tissue fiber) were treated in accordance with the invention of our parent U.S. Pat. No. 4,976,819 disclosure, and not fully in accordance with the invention of this disclosure. Throughout this document, "STF" refers to pulp treated in accordance with our parent U.S. Pat. No. 4,976,819 disclosure. As will be apparent to the viewer, FIG. 2 incorporates the data points from FIG. 1 for comparison. Samples shown within the "untreated" circle in FIG. 2 were the same as the other indicated pulps, yet not treated in accordance with this invention All pulps represented in FIGS. 1 and 2 consisted essentially of western softwoods comprised primarily of Douglas Fir, true firs and western pines. The Pilot Plant 1 pulps were first treated with a plug screw feeder having a compression ratio of about 4.0 to 1 that was also equipped with a blow back damper. Following plug screw feeder treatment, the pulps were fed directly to a Defibrator 300CD model refiner.

The Pilot Plant 2 pulp was first mechanically refined at a consistency of about 25% with a CE Bauer Model 401 atmospheric double disc refiner. Thereafter, it was mechanically treated with plug screw feeder-like equipment (a Pressafiner) having a compression ratio of about 8 to 1 that was not equipped with a blow back damper.

The two Lab Refiner pulps were mechanically refined with a PFI Mill Norwegian laboratory refiner.

It will be noted from FIG. 2 that even with mechanical treatments in accordance with the invention, producing higher bonding results in loss of at least some bulk, as also occurs in the prior art treatment. However, an advantage associated with the invention is clearly evident from FIG. 2. The inventive treatment produces a curve that has been shifted from the conventional refining curve by virtue of the collective inventive treatment. Thus, whereas with conventional treatment a given pulp at a Scott Bond of 90 has a bulk of approximately 1.65, pulp treated in accordance with the invention at a Scott Bond of 90 has a bulk of 1.9. Thus, for any given Scott Bond, pulp treated in accordance with the invention has higher bulk. Accordingly, the inventive treatment enables production of pulp to some desired minimal Scott Bond and results in a pulp having greater bulk than is available with prior art techniques.

Table 1 below demonstrates bulk and Scott Bond properties for different treated pulps. All pulps represented in Table 1 consisted essentially of western softwoods comprised primarily of Douglas Fir, true firs and western pines. The samples designated "Cold" indicates that the pulp was treated in a standard manner including disintegration in a TAPPI standard disintegrator for 5 minutes at room temperature. The samples designated "Hot" indicates that the pulp was disintegrated in a TAPPI standard disintegrator for 10 minutes at about 95° C., to more closely simulate stock preparation before the paper machine. The samples designated "Control" were not subjected to any mechanical treatment. The MMP pulps referred to in the tables in this document were first treated with a plug screw feeder having a compression ratio of about 4.0 to 1 that was also equipped with a blow back damper. Following plug screw feeder treatment, the indicated MMP pulps were fed directly to Defibrator 300CD model refiner.

TABLE 1

Pulp Property Treatment Comparisons

| SAMPLE | CSF (ml) | BULK (cc/g) | BREAKING LENGTH (km) | TEAR FACTOR | SCOTT BOND (ftlb/in$^2$) | FOLD (Number of double folds) | ZERO-SPAN TENSILE (km) | TAPPI DRAIN-AGE (seconds) | WRV (gms $H_2O$/ gms O.D. pulp) | GURLEY STIFF CORR TO BULK |
|---|---|---|---|---|---|---|---|---|---|---|
| Control HOT | 656 | 1.72 | 5.7 | 145 | 76 | 187 | 18 | 4.0 | 1.90 | 58 |
| Control COLD | 681 | 1.75 | 5.1 | 145 | 60 | 83 | 18 | 4.0 | | 56 |
| "MMP" COLD | 662 | 1.98 | 1.5 | 187 | 99 | 7 | 14 | 3.8 | | 25 |
| "MMP" HOT | 636 | 1.89 | 2.3 | 236 | 95 | 18 | 14 | 3.9 | 1.53 | 26 |
| "STF" HOT | 741 | 2.09 | 0.2 | 135 | 42 | 2 | 11 | 3.6 | 1.20 | 16 |
| "STF" COLD | 772 | 2.16 | 0.4 | 97 | 36 | 0 | 10 | 3.6 | | 14 |

It is to be noted that whereas Scott Bonds are in the 60–80 range for untreated control in Table 1, and the soft tissue fiber is in the 40 range, that the MMP samples are in the 95 to 100 range. Accordingly, pulp treated in accordance with this invention produces improved Scott Bonds over those obtained using the invention of our parent U.S. Pat. No. 4,976,819 disclosure. The remaining indicated properties similarly indicate significant differences as compared to prior art pulp as well as pulp treated in accordance with our parent disclosure.

Table 2 displays certain properties of multi-layer handsheets where the core layers were prepared with pulp treated in accordance with the invention and with other pulps. The "other pulps" are the best known commercially available pulps for the core layers(s) of multiply products. All pulps represented in Table 2, except that designated CTMP, consisted essentially of kraft western softwoods comprised primarily of Douglas Fir, true firs and western pines. The outer plies consisted of the same pulps, but conventionally refined to 440–460 CSF. The CTMP pulp of Sample 2 consisted essentially of chemithermomechanical pulp of mixed Canadian softwoods. The handsheets were prepared with roll or extended nip presses, at the indicated pressures. Samples 1 and 2 consisted essentially of the most preferred commercial combination pulp mix for creation of a core ply layer. Sample 3 was STF treated pulp having added starch in an effort to raise ZDT. The added starch was an enzyme converted starch, provided at about 15 lbs. per ton. The Sample 4 pulp consisted of control pulp treated in accordance with this invention.

The reported basis weights are those of a theoretical sheet which is calculated to match a 16.5 point and 210 pound specs. These sheets are also calculated to have 220 Sheffield smoothness and 165 geometric mean Taber stiffness. Solids in and out, and ZDTs, are observed values.

TABLE 2

MULTI-LAYER HANDSHEET RESULTS COMPARISONS BETWEEN COMMERCIAL AND SELECTED SPECIALLY TREATED PULPS

| CORE PLY CONSTRUCTION | | ROLL PRESS (280 PLI) | | | ENP PRESS (1000 PLI) | | |
|---|---|---|---|---|---|---|---|
| SAMPLE NO. | SOLIDS TO PRESS | BASIS WT. | SOLIDS OUT | ZDT | BASIS WT. | SOLIDS OUT | ZDT |
| 1 75%SDK/25%CHIP (620 CSF) | 22–23% | 187 | 35 | 30 | 195 | 40 | 35 |
| 2 50%CTMP/50%CHIP (550 CSF) | 23–24% | 179 | 35 | 20 | — | — | — |
| 3 "STF" + starch (736 CSF) | 30–32% | 191 | 44 | 13 | 180 | 44 | 18 |
| 4 MMP (616 CSF) | 30–32% | 191 | 39 | 47 | 189 | 42 | 54 |

As is evident from Table 2, a sheet with pulp treated in accordance with the invention and placed in the core layer(s) has calculated basis weights in the range of (and at least in one case better than) those sheets with the most preferred core stock finishes (Samples 1 and 2). This means that an equivalent sheet can be made in terms of stiffness, smoothness and basis weight savings compared to these preferred finishes in the core layer(s). In addition, the ZDT's of the sheet with pulp treated in accordance with this invention far exceed those of the other most preferred core finishes. Alternatively, practice of the invention could be adjusted to maintain the same ZDT, while attaining greater product stiffness of basis weight savings (see FIG. 2). Note also that solids content is increased in Sample 4 as compared to Samples 1 and 2. This means that less pressing and drying energy will be required than with the other finishes. Regarding Sample 3, it is provided to illustrate difference between treatment in accordance with the parent U.S. Pat. No. 4,976,819 disclosure, and complete treatment in accordance with the invention of this disclosure. Note, however, that even with added starch the STF pulp does not have adequate Z-bonding for use in multiply products because STF pulp is not normally intended for multiply board applications.

Figure 3:
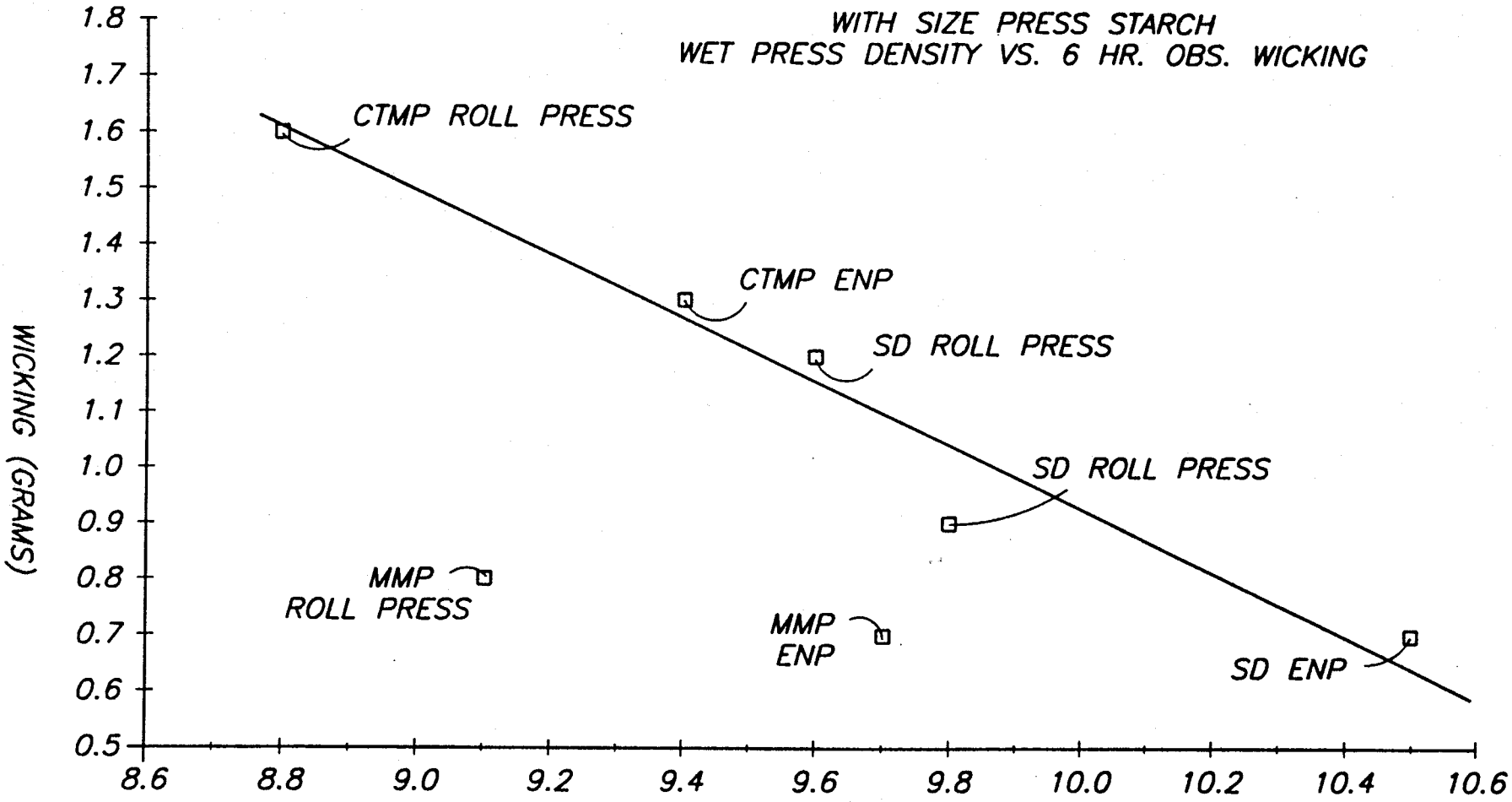
FIG. 3 is a graph of wicking versus uncalendered wet press density of pulp treated in accordance with the invention, and where size starch has been added.
Figure 4:
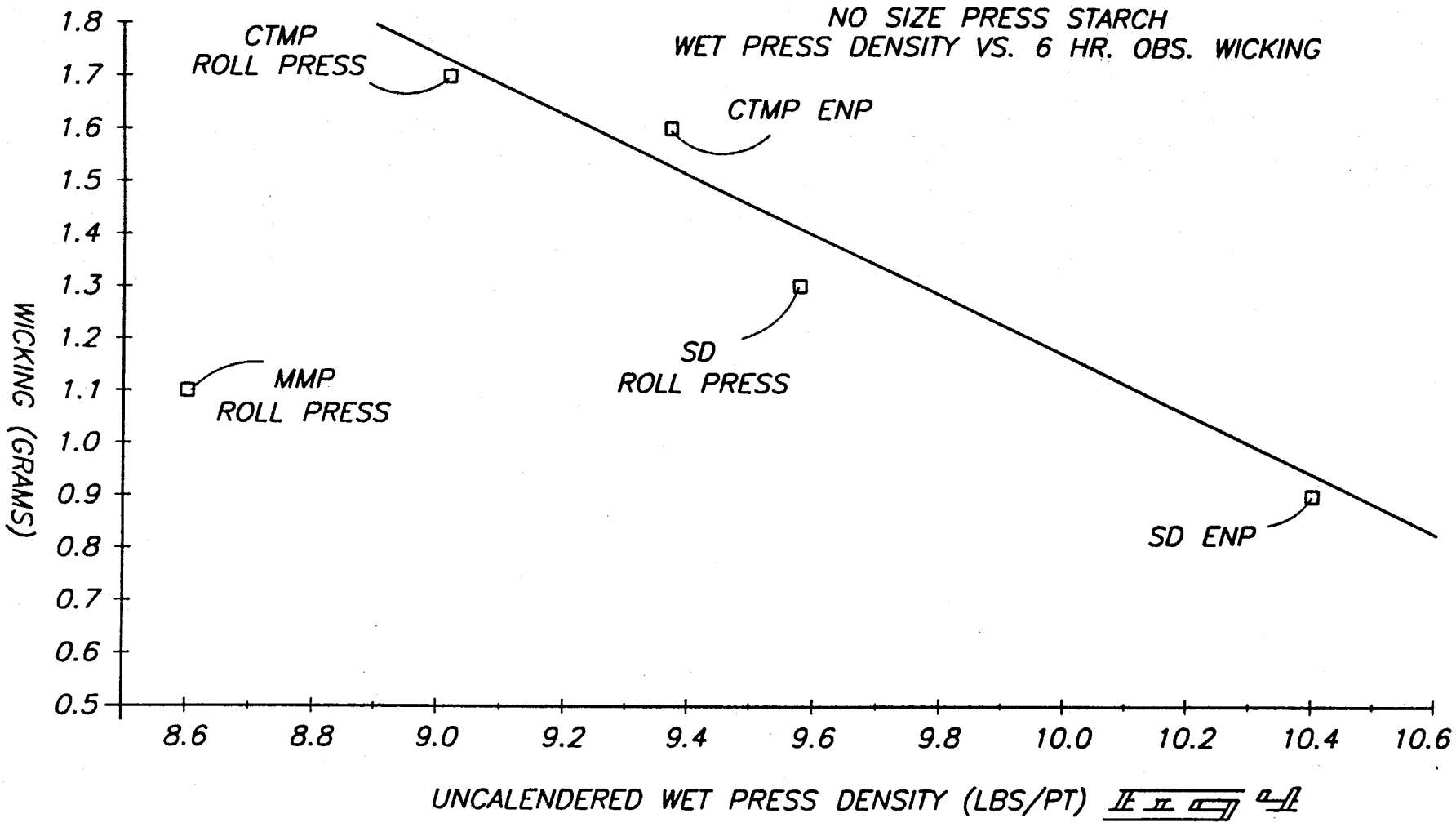
FIG. 4 is a graph of wicking versus uncalendered wet press density of pulp treated in accordance with the invention, and where no size starch has been added.

FIGS. 3 and 4 illustrate comparative accelerated wicking tests of various pulps using a nonionic surfactant in water. All pulps represented in FIGS. 3 and 4 consisted essentially of kraft western softwoods comprised primarily of Douglas Fir, true firs and western pines. Where size starch is indicated as being added, such consisted of enzyme converted size starch added at an amount of about 8 lbs. per ream of paperboard. As is evident from FIGS. 3 and 4, pulp treated in accordance with the invention has reduced wicking over other pulps for a given density.

In compliance with the statute, the invention has been described in language relatively specific as to methodical steps and features. It is to be understood, however, that the invention is not limited to the specific steps and features described, since the means and construction herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A method of processing pulp comprising the following steps:

mechanically refining pulp of up to 50% O.D. consistency; and mechanically treating the mechanically refined pulp by wringing, dewatering and compacting the mechanically refined pulp to permanently twist and kink individual fibers to a degree that is substantially irreversible when they are subsequently subjected to papermaking process steps, the refined and treated pulp having increased bulk and no reduction in Z-directional tensile over the same pulp that has not been mechanically refined and thereafter wrung, dewatered and compacted to twist and kink individual fibers.

2. The method of processing pulp of claim 1 wherein said mechanically refining and mechanically treating increases Z-directional tensile over the same pulp that has not been mechanically refined and thereafter wrung, dewatered and compacted to twist and kink individual fibers.

3. The method of processing pulp of claim 1 wherein the mechanical refining is conducted at a high consistency of at least 20% pulp.

4. The method of processing pulp of claim 1 wherein the mechanical refining is conducted at a high consistency of at least 20% pulp, and wherein said mechanically refining and mechanically treating increases Z-directional tensile over the same pulp that has not been mechanically refined and wrung, dewatered and compacted to twist and kink individual fibers.

5. The method of processing pulp of claim 1 wherein the step of wringing, dewatering and compacting the pulp comprises moving the pulp along an annular path of decreasing volume.

6. The method of processing pulp of claim 5 wherein the step of wringing, dewatering and compacting the pulp comprises passing the pulp through a plug-screw feeder.

7. The method of processing pulp of claim 6 further comprising restricting the flow of pulp exiting from the plug screw feeder.

8. The method of processing pulp of claim 1 wherein wringing, dewatering and compacting of the pulp occur simultaneously.

9. The method of processing pulp of claim 5 wherein said mechanically refining and mechanically treating increases Z-directional tensile over the same pulp that has not been mechanically refined and thereafter wrung, dewatered and compacted to twist and kink individual fibers.

10. The method of processing pulp of claim 5 wherein the mechanical refining is conducted at a high consistency of at least 20% pulp.

11. The method of processing pulp of claim 5 wherein the mechanical refining is conducted at a high consistency of at least 20% pulp, and wherein said mechanically refining and mechanically treating increases Z-directional tensile over the same pulp that has not been mechanically refined and wrung, dewatered and compacted to twist and kink individual fibers.

12. The method of processing pulp of claim 6 wherein the mechanical refining is conducted at a high consistency of at least 20% pulp.

13. The method of processing pulp of claim 7 wherein the mechanical refining is conducted at a high consistency of at least 20% pulp, and wherein said mechanically refining and mechanically treating increases Z-directional tensile over the same pulp that has not been mechanically refined and wrung, dewatered and compacted to twist and kink individual fibers.

14. A method of processing pulp comprising the following steps:

mechanically treating pulp of up to 50% O.D. consistency by wringing, dewatering and compacting the pulp to permanently twist and kink individual fibers to a degree that is substantially irreversible when they are subsequently subjected to papermaking process steps: and mechanically refining the mechanically treated pulp, the treated and refined pulp having increased bulk and no reduction in Z-directional tensile over the same pulp that has not been wrung, dewatered and compacted to twist and kink individual fibers and thereafter mechanically refined.

15. The method of processing pulp of claim 14 wherein said mechanically treating and mechanically refining increases Z-directional tensile over the same pulp that has not been wrung, dewatered and compacted to twist and kink individual fibers and thereafter mechanically refined.

16. The method of processing pulp of claim 14 wherein the mechanical refining is conducted at a high consistency of at least 20% pulp.

17. The method of processing pulp of claim 14 wherein the mechanical refining is conducted at a high consistency of at least 20% pulp, and wherein said mechanically treating and mechanically refining increases Z-directional tensile over the same pulp that has not been wrung, dewatered and compacted to twist and kink individual fibers and thereafter mechanically refined.

18. The method of processing pulp of claim 14 wherein the step of wringing, dewatering and compacting the pulp comprises moving the pulp along an annular path of decreasing volume.

19. The method of processing pulp of claim 18 wherein the step of wringing, dewatering and compacting the pulp comprises passing the pulp through a plug-screw feeder.

20. The method of processing pulp of claim 19 further comprising restricting the flow of pulp exiting from the plug screw feeder.

21. The method of processing pulp of claim 14 wherein wringing, dewatering and compacting of the pulp occur simultaneously.

22. The method of processing pulp of claim 18 wherein said mechanically treating and mechanically refining increases Z-directional tensile over the same pulp that has not been wrung, dewatered and compacted to twist and kink individual fibers and thereafter mechanically refined.

23. The method of processing pulp of claim 18 wherein the mechanical refining is conducted at a high consistency of at least 20% pulp.

24. The method of processing pulp of claim 18 wherein the mechanical refining is conducted at a high consistency of at least 20% pulp, and wherein said mechanically treating and mechanically refining increases Z-directional tensile over the same pulp that has not been wrung, dewatered and compacted to twist and kink individual fibers and thereafter mechanically refined.

25. The method of processing pulp of claim 19 wherein the mechanical refining is conducted at a high consistency of at least 20% pulp.

26. The method of processing pulp of claim 20 wherein the mechanical refining is conducted at a high consistency of at least 20% pulp, and wherein said mechanically treating and mechanically refining increases Z-directional tensile over the same pulp that has not been wrung, dewatered and compacted to twist and kink individual fibers and thereafter mechanically refined.

27. A method of producing a multilayer paper product having outer and core layers, the method comprising the following steps:

mechanically refining pulp of up to 50% O.D. consisency;

mechanically treating the mechanically refined pulp by wringing, dewatering and compacting the mechanically refined pulp to permanently twist and kink individual fibers to a degree that is substantially irreversible when they are subsequently subjected to papermaking process steps and thereby forming a core ply pulp, the core ply pulp having increased bulk and no reduction in Z-directional tensile over the same pulp that has not been mechanically refined and thereafter wrung, dewatered and compacted to twist and kink individual fibers;

forming the core ply pulp into a sheet in a wet end of a papermachine either together or in a separate step with formation of outer sheet layers; and pressing and drying the outer and core sheets to produce a multilayer paper product having increased bulk and no reduction in Z-directional tensile in the core ply over a multilayer paper product produced with the same pulps having a core ply pulp that has not been mechanically refined and thereafter wrung, dewatered and compacted to twist and kink individual fibers.

28. The method of producing a multilayer paper product of claim 27 wherein said mechanically refining and mechanically treating increases Z-directional tensile over the same pulp that has not been mechanically refined and thereafter wrung, dewatered and compacted to twist and kink individual fibers.

29. The method of producing a multilayer paper product of claim 27 wherein the mechanical refining is conducted at a high consistency of at least 20% pulp.

30. The method of producing a multilayer paper product of claim 27 wherein the mechanical refining is conducted at a high consistency of at least 20% pulp, and wherein said mechanically refining and mechanically treating increases Z-directional tensile over the same pulp that has not been mechanically refined and wrung, dewatered and compacted to twist and kink individual fibers.

31. The method of producing a multilayer paper product of claim 27 wherein the step of wringing, dewatering and compacting the pulp comprises moving the pulp along an annular path of decreasing volume.

32. The method of producing a multilayer paper product of claim 31 wherein the step of wringing, dewatering and compacting the pulp comprises passing the pulp through a plug-screw feeder.

33. The method of producing a multilayer paper product of claim 32 further comprising restricting the flow of pulp exiting from the plug screw feeder.

34. The method of producing a multilayer paper product of claim 27 wherein wringing, dewatering and compacting of the pulp occur simultaneously.

35. The method of producing a multilayer paper product of claim 31 wherein said mechanically refining and mechanically treating increases Z-directional tensile over the same pulp that has not been mechanically refined and thereafter wrung, dewatered and compacted to twist and kink individual fibers.

36. The method of producing a multilayer paper product of claim 31 wherein the mechanical refining is conducted at a high consistency of at least 20% pulp.

37. The method of producing a multilayer paper product of claim 31 wherein the mechanical refining is conducted at a high consistency of at least 20% pulp, and wherein said mechanically refining and mechanically treating increases Z-directional tensile over the same pulp that has not been mechanically refined and wrung, dewatered and compacted to twist and kink individual fibers.

38. The method of producing a multilayer paper product of claim 32 wherein the mechanical refining is conducted at a high consistency of at least 20% pulp.

39. The method of producing a multilayer paper product of claim 33 wherein the mechanical refining is conducted at a high consistency of at least 20% pulp, and wherein said mechanically refining and mechanically treating increases Z-directional tensile over the same pulp that has not been mechanically refined and wrung, dewatered and compacted to twist and kink individual fibers.

40. A method of producing a multilayer paper product having outer and core layers, the method comprising the following steps:

mechanically treating pulp of up to 50% O.D. consistency by wringing, dewatering and compacting the pulp to permanently twist and kink individual fibers to a degree that is substantially irreversible when they are subsequently subjected to papermaking process steps;

mechanically refining the mechanically treated pulp and thereby forming a core ply pulp, the core ply pulp having increased bulk and no reduction in Z-directional tensile over the same pulp that has not been wrung, dewatered and compacted to twist and kink individual fibers and thereafter mechanically refined;

forming the core ply pulp into a sheet in a wet end of a papermachine either together or in a separate step with formation of outer sheet layers; and pressing and drying the outer and core sheets to produce a multilayer paper product having increased bulk and no reduction in Z-directional tensile in the core ply over a multilayer paper product produced with the same pulps having a core ply pulp that has not been wrung, dewatered and compacted to twist and kink individual fibers and thereafter mechanically refined.

41. The method of producing a multilayer paper product of claim 40 wherein said mechanically treating and mechanically refining increases Z-directional tensile over the same pulp that has not been wrung, dewatered and compacted to twist and kink individual fibers and thereafter mechanically refined.

42. The method of producing a multilayer paper product of claim 40 wherein the mechanical refining is conducted at a high consistency of at least 20% pulp.

43. The method of producing a multilayer paper product of claim 40 wherein the mechanical refining is conducted at a high consistency of at least 20% pulp, and wherein said mechanically treating and mechanically refining increases Z-directional tensile over the same pulp that has not been wrung, dewatered and compacted to twist and kink individual fibers and thereafter mechanically refined.

44. The method of producing a multilayer paper product of claim 40 wherein the step of wringing, dewatering and compacting the pulp comprises moving the pulp along an annular path of decreasing volume.

45. The method of producing a multilayer paper product of claim 44 wherein the step of wringing, dewatering and compacting the pulp comprises passing the pulp through a plug-screw feeder.

46. The method of producing a multilayer paper product of claim 45 further comprising restricting the flow of pulp exiting from the plug screw feeder.

47. The method of producing a multilayer paper product of claim 40 wherein wringing, dewatering and compacting of the pulp occur simultaneously.

48. The method of producing a multilayer paper product of claim 44 wherein said mechanically treating and mechanically refining increases Z-directional tensile over the same pulp that has not been wrung, dewatered and compacted to twist and kink individual fibers and thereafter mechanically refined.

49. The method of producing a multilayer paper product of claim 44 wherein the mechanical refining is conducted at a high consistency of at least 20% pulp.

50. The method of producing a multilayer paper product of claim 44 wherein the mechanical refining is conducted at a high consistency of at least 20% pulp, and wherein said mechanically treating and mechanically refining increases Z-directional tensile over the same pulp that has not been wrung, dewatered and compacted to twist and kink individual fibers and thereafter mechanically refined.

51. The method of producing a multilayer paper product of claim 45 wherein the mechanical refining is conducted at a high consistency of at least 20% pulp.

52. The method of producing a multilayer paper product of claim 46 wherein the mechanical refining is conducted at a high consistency of at least 20% pulp, and wherein said mechanically treating and mechanically refining increases Z-directional tensile over the same pulp that has not been wrung, dewatered and compacted to twist and kink individual fibers and thereafter mechanically refined.

53. A method of producing a multilayer paperboard product for use in containment of liquids, the paperboard product having outer and core layers, the method comprising the following steps:

mechanically refining pulp of up to 50% O.D. consistency;

mechanically treating the mechanically refined pulp by wringing, dewatering and compacting the mechanically refined pulp to permanently twist and kink individual fibers to a degree that is substantially irreversible when they are subsequently subjected to papermaking process steps and thereby forming a core ply pulp, the core ply pulp having, increased bulk;

no reduction in Z-directional tensile; and reduced wicking, over the same pulp that has not been mechanically refined and thereafter wrung, dewatered and compacted to twist and kink individual fibers;

forming the core ply pulp into a sheet in a wet end of a papermachine either together or in a separate step with formation of outer sheet layers; and pressing and drying the outer and core sheets to produce a multilayer paperboard product having increased bulk, no reduction in Z-directional tensile, and reduced wicking in the core ply over a multilayer paperboard product produced with the same pulps having a core ply pulp that has not been mechanically refined and thereafter wrung, dewatered and compacted to twist and kink individual fibers.

54. The method of producing a multilayer paperboard product for use in containment of liquids of claim 53 wherein said mechanically refining and mechanically treating increases Z-directional tensile over the same pulp that has not been mechanically refined and thereafter wrung, dewatered and compacted to twist and kink individual fibers.

55. The method of producing a multilayer paperboard product for use in containment of liquids of claim 53 wherein the mechanical refining is conducted at a high consistency of at least 20% pulp.

56. The method of producing a multilayer paperboard product for use in containment of liquids of claim 53 wherein the mechanical refining is conducted at a high consistency of at least 20% pulp, and wherein said mechanically refining and mechanically treating increases Z-directional tensile over the same pulp that has not been mechanically refined and wrung, dewatered and compacted to twist and kink individual fibers.

57. The method of producing a multilayer paperboard product for use in containment of liquids of claim 53 wherein the step of wringing, dewatering and compacting the pulp comprises moving the pulp along an annular path of decreasing volume.

58. The method of producing a multilayer paperboard product for use in containment of liquids of claim 57 wherein the step of wringing, dewatering and compacting the pulp comprises passing the pulp through a plug-screw feeder.

59. The method of producing a multilayer paperboard product for use in containment of liquids of claim 58 further comprising restricting the flow of pulp exiting from the plug screw feeder.

60. The method of producing a multilayer paperboard product for use in containment of liquids of claim 53 wherein wringing, dewatering and compacting of the pulp occur simultaneously.

61. The method of producing a multilayer paperboard product for use in containment of liquids of claim 57 wherein said mechanically refining and mechanically treating increases Z-directional tensile over the same pulp that has not been mechanically refined and thereafter wrung, dewatered and compacted to twist and kink individual fibers.

62. The method of producing a multilayer paperboard product for use in containment of liquids of claim 57 wherein the mechanical refining is conducted at a high consistency of at least 20% pulp.

63. The method of producing a multilayer paperboard product for use in containment of liquids of claim 57 wherein the mechanical refining is conducted at a high consistency of at least 20% pulp, and wherein said mechanically refining and mechanically treating increases Z-directional tensile over the same pulp that has not been mechanically refined and wrung, dewatered and compacted to twist and kink individual fibers.

64. The method of producing a multilayer paperboard product for use in containment of liquids of claim 58 wherein the mechanical refining is conducted at a high consistency of at least 20% pulp.

65. The method of producing a multilayer paperboard product for use in containment of liquids of claim 59 wherein the mechanical refining is conducted at a high consistency of at least 20% pulp, and wherein said mechanically refining and mechanically treating increases Z-directional tensile over the same pulp that has not been mechanically refined and wrung, dewatered and compacted to twist and kink individual fibers.

66. A method of producing a multilayer paperboard product having outer and core layers for use in containment of liquids, the method comprising the following steps:

mechanically treating pulp of up to 50% O.D. consistency by wringing, dewatering and compacting the pulp to permanently twist and kink individual fibers to a degree that is substantially irreversible when they are subsequently subjected to papermaking process steps;

mechanically refining the mechanically treated pulp and thereby forming a core ply pulp, the core ply pulp having, increased bulk;

no reduction in Z-directional tensile; and reduced wicking, over the same pulp that has not been wrung, dewatered and compacted to twist and kink individual fibers and thereafter mechanically refined;

forming the core ply pulp into a sheet in a wet end of a papermachine either together or in a separate step with formation of outer sheet layers; and pressing and drying the outer and core sheets to produce a multilayer paperboard product having increased bulk, no reduction in Z-directional tensile, and reduced wicking in the core ply over a multilayer paperboard product produced with the same pulps having a core ply pulp that has not been wrung, dewatered and compacted to twist and kink individual fibers and thereafter mechanically refined.

67. The method of producing a multilayer paperboard product for use in containment of liquids of claim 66 wherein said mechanically treating and mechanically refining increases Z-directional tensile over the same pulp that has not been wrung, dewatered and compacted to twist and kink individual fibers and thereafter mechanically refined.

68. The method of producing a multilayer paperboard product for use in containment of liquids of claim 66 wherein the mechanical refining is conducted at a high consistency of at least 20% pulp.

69. The method of producing a multilayer paperboard product for use in containment of liquids of claim 66 wherein the mechanical refining is conducted at a high consistency of at least 20% pulp, and wherein said mechanically treating and mechanically refining increases Z-directional tensile over the same pulp that has not been wrung, dewatered and compacted to twist and kink individual fibers and thereafter mechanically refined.

70. The method of producing a multilayer paperboard product for use in containment of liquids of claim 66 wherein the step of wringing, dewatering and compacting the pulp comprises moving the pulp along an annular path of decreasing volume.

71. The method of producing a multilayer paperboard product for use in containment of liquids of claim 70 wherein the step of wringing, dewatering and compacting the pulp comprises passing the pulp through a plug-screw feeder.

72. The method of producing a multilayer paperboard product for use in containment of liquids of claim 71 further comprising restricting the flow of pulp exiting from the plug screw feeder.

73. The method of producing a multilayer paperboard product for use in containment of liquids of claim 66 wherein wringing, dewatering and compacting of the pulp occur simultaneously.

74. The method of producing a multilayer paperboard product for use in containment of liquids of claim 70 wherein said mechanically treating and mechanically refining increases Z-directional tensile over the same pulp that has not been wrung, dewatered and compacted to twist and kink individual fibers and thereafter mechanically refined.

75. The method of producing a multilayer paperboard product for use in containment of liquids of claim 70 wherein the mechanical refining is conducted at a high consistency of at least 20% pulp.

76. The method of producing a multilayer paperboard product for use in containment of liquids of claim 70 wherein the mechanical refining is conducted at a high consistency of at least 20% pulp, and wherein said mechanically treating and mechanically refining increases Z-directional tensile over the same pulp that has not been wrung, dewatered and compacted to twist and kink individual fibers and thereafter mechanically refined.

77. The method of producing a multilayer paperboard product for use in containment of liquids of claim 71 wherein the mechanical refining is conducted at a high consistency of at least 20% pulp.

78. The method of producing a multilayer paperboard product for use in containment of liquids of claim 72 wherein the mechanical refining is conducted at a high consistency of at least 20% pulp, and wherein said mechanically treating and mechanically refining increases Z-directional tensile over the same pulp that has not been wrung, dewatered and compacted to twist and kink individual fibers and thereafter mechanically refined.

79. A method of producing a paperboard product for use in containment of liquids comprising the following steps:

mechanically refining pulp of up to 50% O.D. consistency;

mechanically treating the mechanically refined pulp by wringing, dewatering and compacting the mechanically refined pulp to permanently twist and kink individual fibers to a degree that is substantially irreversible when they are subsequently subjected to papermaking process steps, the mechanically refined and mechanically treated pulp having, increased bulk;

no reduction in Z-directional tensile; and reduced wicking, over the same pulp that has not been mechanically refined and thereafter wrung, dewatered and compacted to twist and kink individual fibers.

80. A method of producing a paperboard product for use in containment of liquids comprising the following steps:

mechanically treating pulp of up to 50% O.D. consistency by wringing, dewatering and compacting the pulp to permanently twist and kink individual fibers to a degree that is substantially irreversible when they are subsequently subjected to papermaking process steps;

mechanically refining the mechanically treated pulp, the mechanically refined and mechanically treated pulp having, increased bulk;

no reduction in Z-directional tensile; and reduced wicking, over the same pulp that has not been wrung, dewatered and compacted to twist and kink individual fibers and thereafter mechanically refined.

* * * * *